US012805643B2

(12) United States Patent
Alletto, Jr. et al.

(10) Patent No.: US 12,805,643 B2
(45) Date of Patent: Nov. 24, 2026

(54) BEDDING SYSTEM

(71) Applicant: BEDGEAR, LLC, Farmingdale, NY (US)

(72) Inventors: Eugene Alletto, Jr., Glen Head, NY (US); Lorenzo Turicchia, Arlington, MA (US)

(73) Assignee: Bedgear, LLC, Farmingdale, NY (US)

( * ) Notice: Subject to any disclaimer, the term of this patent is extended or adjusted under 35 U.S.C. 154(b) by 0 days.

(21) Appl. No.: 16/751,859

(22) Filed: Jan. 24, 2020

(65) Prior Publication Data

US 2020/0237106 A1 Jul. 30, 2020

Related U.S. Application Data

(60) Provisional application No. 62/796,867, filed on Jan. 25, 2019.

(51) Int. Cl.
*A47C 21/04* (2006.01)
*A47C 27/00* (2006.01)

(52) U.S. Cl.
CPC ..... *A47C 21/044* (2013.01); *A47C 27/007* (2013.01)

(58) Field of Classification Search
CPC ... A47C 21/044; A47C 27/007; A47C 21/048; A47C 23/043
USPC ..... 5/726
See application file for complete search history.

(56) References Cited

U.S. PATENT DOCUMENTS 3,529,310 A * 9/1970 Olmo ..... A47C 27/04 5/423
3,585,356 A * 6/1971 Hall ..... A47C 27/085 5/422
3,713,182 A * 1/1973 McNeal ..... A47C 21/022 5/421
3,757,362 A * 9/1973 Bowlin ..... A47C 27/087 5/656
4,162,393 A * 7/1979 Balboni ..... A47C 21/048 219/217
4,449,261 A * 5/1984 Magnusson ..... A47C 27/066 5/722
4,635,620 A * 1/1987 Ricchio ..... A47C 21/048 5/670

(Continued)

FOREIGN PATENT DOCUMENTS

WO WO2015106258 A1 * 7/2015 ..... A47C 21/04
WO 2018022760 A1 2/2018

OTHER PUBLICATIONS

WO2020154717 Written Opinion of the International Searching Authority, International Search Report dated Jul. 30, 2020.
Australian Government, IP Australia, Examination report No. 1 for standard patent application, Application No. 2021206887, Date of mailing: Feb. 14, 2023.

(Continued)

*Primary Examiner* — Justin C Mikowski
*Assistant Examiner* — Luke Hall
(74) *Attorney, Agent, or Firm* — Sorell, Lenna & Schmidt, LLP

(57) ABSTRACT

A bedding system includes a base. A pressure generator is coupled to the base. A spacer is positioned over the base. A coil pack is positioned over the spacer. The coil pack is positioned within a recess of an encasement. A duct includes a first end that is in communication with the pressure generator and a second end that is in communication with the recess. A comfort layer is positioned over the encasement. A cover is positioned over the comfort layer.

25 Claims, 18 Drawing Sheets

(56) References Cited

U.S. PATENT DOCUMENTS 4,737,998 A * 4/1988 Johnson, Sr. ..... A47C 21/048 5/422
4,825,488 A * 5/1989 Bedford ..... A47C 21/044 5/726
5,081,339 A * 1/1992 Stine ..... A47C 21/048 219/217
5,335,381 A * 8/1994 Chang ..... A47C 21/048 297/180.14
5,416,935 A * 5/1995 Nieh ..... A47C 21/044 297/180.13
5,430,900 A * 7/1995 Kim ..... A47C 21/048 5/284
5,473,783 A * 12/1995 Allen ..... A47C 21/044 5/423
5,493,742 A * 2/1996 Klearman ..... A47C 27/082 5/423
5,603,131 A * 2/1997 DeJean, Jr. ..... A47C 21/044 5/672
5,640,728 A * 6/1997 Graebe ..... A47C 7/744 5/423
5,966,759 A * 10/1999 Sanders ..... A47C 27/007 5/699
6,115,861 A * 9/2000 Reeder ..... A61G 7/05776 5/722
6,148,457 A * 11/2000 Sul ..... A47C 21/048 5/284
6,886,197 B1 * 5/2005 Madigan ..... A47G 9/02 5/493
7,007,329 B2 * 3/2006 Metzger ..... A47C 31/105 5/691
7,370,380 B2 * 5/2008 DeFranks ..... A47C 27/00 5/954
8,082,612 B2 * 12/2011 Saunders ..... A47C 27/007 5/502
8,356,371 B2 * 1/2013 Howard ..... A47C 27/05 5/690
8,997,279 B1 * 4/2015 McKay ..... A47C 27/085 5/423
10,477,978 B1 * 11/2019 Youngblood ..... F25B 21/04
10,912,694 B1 * 2/2021 Baksh ..... A47C 31/005
2003/0019044 A1 * 1/2003 Larsson ..... A47C 31/007 5/724
2003/0033790 A1 * 2/2003 Hague ..... B01D 46/10 55/385.1
2004/0182087 A1 * 9/2004 Huang ..... A47C 27/082 62/3.3
2007/0136952 A1 * 6/2007 Sargent ..... A47C 27/144 5/726
2009/0013470 A1 * 1/2009 Richards ..... A61G 7/05784 5/613
2009/0064411 A1 * 3/2009 Marquette ..... B60H 1/00742 5/423
2009/0100606 A1 * 4/2009 An ..... A47C 27/15 5/690
2010/0287701 A1 * 11/2010 Frias ..... A47C 27/082 5/423
2010/0319125 A1 * 12/2010 Ko ..... A47C 21/048 5/423
2011/0109128 A1 * 5/2011 Axakov ..... A47C 21/044 297/180.1
2012/0311784 A1 * 12/2012 Yoon ..... A47C 21/048 5/423
2013/0326811 A1 * 12/2013 Miles ..... A47D 15/001 5/423
2014/0201925 A1 * 7/2014 Tursi, Jr. ..... A47C 17/86 5/722
2015/0033474 A1 * 2/2015 Mikkelsen ..... A47G 9/1036 5/421
2015/0182032 A1 * 7/2015 Jensen ..... G09F 3/00 5/699
2015/0208814 A1 * 7/2015 Alletto, Jr. ..... A47C 21/044 5/423
2015/0289667 A1 * 10/2015 Oakhill ..... A47C 21/044 5/423
2016/0157631 A1 * 6/2016 Milnes ..... A47C 27/148 5/699
2018/0098637 A1 * 4/2018 Griese ..... A47C 27/15
2018/0242753 A1 * 8/2018 Ghanei ..... A47C 27/056

OTHER PUBLICATIONS

Australian Examination Report. Australian Application No. 2024200947. Received Jul. 28, 2025.
Australian Examination Report No. 2. Australian Application No. 2024200947. Dated Mar. 16, 2026. 3 pgs.

* cited by examiner

BEDDING SYSTEM

TECHNICAL FIELD

The present disclosure generally relates to bedding, and more particularly to bedding systems that are modular and configured to be personalized based on comfort choices and that includes individual components that can be upgraded and/or replaced.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that is comfortable in order to achieve restful sleep.

Two popular mattress choices currently available are spring mattresses and foam mattresses. However, because foam mattresses consist of a foam, such as, for example, memory foam, such foam mattresses are typically not sturdy enough to provide proper support to a sleeper's body. Foam mattresses also lack the ability to clean within the foam mattress or replace components of the foam mattress over time. For example, if the sleeper's desired comfort choice changes over time, he or she will be required to purchase a completely new foam mattress to accommodate the user's new comfort choice. Spring mattresses are typically pre-assembled and are shipped to a destination as freight due to the size of the spring mattress. That is, most spring mattresses cannot be shipped by ground delivery because the spring mattresses each exceed the size permitted for ground delivery. Moreover, because spring mattresses are typically pre-assembled, spring mattresses lack the ability to clean within the spring mattress or replace components of the spring mattress over time. For example, if the springs of the spring mattress wear out, the sleeper will be required to purchase a completely new spring mattress.

Furthermore, conventional mattresses lack any means to draw ambient air away from a sleeping surface of the mattress and/or to direct air flow to the sleep surface. Conventional mattresses also lack a temperature control system capable of being controlled to apply different temperature environments on different regions of the sleeping surface. This disclosure describes an improvement over these prior art technologies.

SUMMARY

In one embodiment, in accordance with the principles of the present disclosure, a bedding system is provided that includes a base and a pressure generator coupled to the base. A spacer is positioned over the base. A coil pack is positioned over the spacer. The coil pack is positioned within a recess of an encasement. A duct includes a first end that is in communication with the pressure generator and a second end that is in communication with the recess. A comfort layer is positioned over the encasement. A cover is positioned over the comfort layer.

In one embodiment, in accordance with the principles of the present disclosure, the encasement comprises opposite top and bottom walls and a side wall extending from the top wall to the bottom wall, the top and bottom walls being porous, the side wall being non-porous.

In one embodiment, in accordance with the principles of the present disclosure, the encasement comprises opposite top and bottom walls and a side wall extending from the top wall to the bottom wall, the top and bottom walls being permeable, the side wall being completely impervious to air flow therethrough.

In one embodiment, in accordance with the principles of the present disclosure, the base includes a platform that is positioned between the pressure generator and the spacer.

In one embodiment, in accordance with the principles of the present disclosure, the base includes a platform, the pressure generator being positioned below the platform, the spacer being positioned above the platform.

In one embodiment, in accordance with the principles of the present disclosure, the coil pack comprises a pocket and a plurality of springs positioned in the pocket.

In one embodiment, in accordance with the principles of the present disclosure, the comfort layer is perforated for airflow therethrough.

In one embodiment, in accordance with the principles of the present disclosure, the comfort layer includes a plurality of spaced apart channels that each extend completely through a thickness of the comfort layer.

In one embodiment, in accordance with the principles of the present disclosure, the cover is configured to allow air and/or moisture to move through a thickness of the cover.

In one embodiment, in accordance with the principles of the present disclosure, a bedding system is provided that includes a base and first and second pressure generators that are coupled to the base. A spacer is positioned over the base. A first coil pack positioned is over the spacer. The first coil pack is positioned within a first recess of a first encasement. A second coil pack is positioned over the spacer. The second coil pack is positioned within a second recess of a second encasement. A first duct includes a first end that is in communication with the first pressure generator and a second end that is in communication with the first recess. A second duct includes a first end that is in communication with the second pressure generator and a second end that is in communication with the second recess. A comfort layer is positioned over the encasements. A cover is positioned over the comfort layer.

In one embodiment, in accordance with the principles of the present disclosure, the encasements each comprise opposite top and bottom walls and a side wall extending from the top wall to the bottom wall, the top and bottom walls being porous, the side wall being non-porous.

In one embodiment, in accordance with the principles of the present disclosure, the encasements each comprise opposite top and bottom walls and a side wall extending from the top wall to the bottom wall, the top and bottom walls being permeable, the side wall being completely impervious to air flow therethrough.

In one embodiment, in accordance with the principles of the present disclosure, the base includes a platform that is positioned between the pressure generators and the spacer.

In one embodiment, in accordance with the principles of the present disclosure, the base includes a platform, the pressure generators being positioned below the platform, the spacer being positioned above the platform.

In one embodiment, in accordance with the principles of the present disclosure, the pressure generators are fans and the bedding system includes void space between the fans and the platform.

In one embodiment, in accordance with the principles of the present disclosure, the coil packs each comprise a pocket and a plurality of springs positioned in the pocket.

In one embodiment, in accordance with the principles of the present disclosure, the comfort layer is perforated for airflow therethrough.

In one embodiment, in accordance with the principles of the present disclosure, the comfort layer includes a plurality of spaced apart channels that each extend completely through a thickness of the comfort layer.

In one embodiment, in accordance with the principles of the present disclosure, the cover is configured to allow air and/or moisture to move through a thickness of the cover.

In one embodiment, in accordance with the principles of the present disclosure, a bedding system is provided that includes a base comprising a platform. First and second fans are coupled to the base. A spacer is positioned over the base such that the platform is positioned between the fans and the spacer. The bedding system includes void space between the fans and the platform. A first coil pack is positioned over the spacer, the first coil pack being positioned within a first recess of a first encasement, the first encasement comprising opposite top and bottom walls and a side wall extending from the top wall to the bottom wall, the top and bottom walls being permeable, the side wall being completely impervious to air flow therethrough, the first coil pack comprising a pocket and a plurality of springs positioned in the pocket. A second coil pack is positioned over the spacer, the second coil pack being positioned within a second recess of a second encasement, the second encasement comprising opposite top and bottom walls and a side wall extending from the top wall of the second encasement to the bottom wall of the second encasement, the top and bottom walls of the second encasement being permeable, the side wall of the second encasement being completely impervious to air flow therethrough, the second coil pack comprising a pocket and a plurality of springs positioned in the pocket of the second coil pack. A first duct includes a first end that is in communication with the first fan and a second end that is in communication with the first recess. A second duct includes a first end that is in communication with the second fan and a second end that is in communication with the second recess. A perforated comfort layer is positioned over the encasements. A cover is positioned over the comfort layer, the cover being configured to allow air and/or moisture to move through a thickness of the cover.

In one embodiment, in accordance with the principles of the present disclosure, a bedding system is provided that includes a chassis comprising a bottom wall, opposite first and second side walls extending upwardly from the bottom wall and opposite first and second end walls extending upwardly from the bottom wall, the walls defining a cavity. A support assembly is positioned in the cavity and includes a spacer and a coil pack comprising a plurality of springs. The support assembly comprises an encasement that surrounds the spacer and the coil pack. A first cover is positioned over the support assembly. A comfort layer is positioned over the first cover. A second cover is positioned over the comfort layer.

In one embodiment, in accordance with the principles of the present disclosure, a pressure generator is coupled to the support assembly, the pressure generator being configured to create positive pressure that moves air and/or moisture within the pressure generator through the support assembly, the first cover, the comfort layer and the second cover.

In one embodiment, in accordance with the principles of the present disclosure, a pressure generator is coupled to the support assembly, the pressure generator being configured to create negative pressure that moves air and/or moisture adjacent to the second cover, through the second cover, the comfort layer, the first cover, the support assembly and into the pressure generator.

In one embodiment, in accordance with the principles of the present disclosure, the first cover is attached to the chassis by a zipper.

In one embodiment, in accordance with the principles of the present disclosure, the comfort layer is attached to the chassis by a zipper.

In one embodiment, in accordance with the principles of the present disclosure, the second cover is attached to the chassis by a zipper.

In one embodiment, in accordance with the principles of the present disclosure, the cavity defines a perimeter, the first zipper being positioned about the perimeter such that the first zipper extends entirely around the perimeter.

In one embodiment, in accordance with the principles of the present disclosure, the side walls and the end walls each include an inner surface and an opposite outer surface, the inner surfaces and the bottom wall defining the cavity, the second zipper extending continuously along the outer surfaces.

In one embodiment, in accordance with the principles of the present disclosure, the chassis comprises a body and a plurality of flaps that are each coupled to the body, the third zipper extending along the body and the flaps. In one embodiment, in accordance with the principles of the present disclosure, the flaps are movable relative to the body. In one embodiment, in accordance with the principles of the present disclosure, the flaps are each positioned at a corner of the body. In one embodiment, in accordance with the principles of the present disclosure, the body includes opposite top and bottom surfaces, the flaps each extending above the top surface.

In one embodiment, in accordance with the principles of the present disclosure, the chassis includes opposite top and bottom surfaces, a portion of the third zipper being fixed to the chassis at a position between the top surface and the bottom surface.

In one embodiment, in accordance with the principles of the present disclosure, the chassis is compressible.

In one embodiment, in accordance with the principles of the present disclosure, the support assembly comprises a first support assembly including a first spacer and a first coil pack and a second support assembly including a second spacer and a second coil pack, the first support assembly being removably coupled to the second support assembly.

In one embodiment, in accordance with the principles of the present disclosure, the spacer comprises a platform that is supported by legs, the platform comprising a plurality of holes that extend through a thickness of the spacer to allow air and/or moisture to go through the spacer and into the coil pack.

In one embodiment, in accordance with the principles of the present disclosure, the second cover comprises a breathable material. In one embodiment, in accordance with the principles of the present disclosure, the second cover comprises a breathable material having pores that are greater than 3.0 microns. In one embodiment, in accordance with the principles of the present disclosure, the second cover comprises a breathable material having pores that are about 10.0 microns.

In one embodiment, in accordance with the principles of the present disclosure, the chassis is free of hinges.

In one embodiment, in accordance with the principles of the present disclosure, a bedding kit is provided that includes a chassis comprising a bottom wall, opposite first and second side walls extending upwardly from the bottom wall and opposite first and second end walls extending upwardly from the bottom wall. The walls define a cavity. A coil pack is configured to be positioned in the cavity. The coil pack comprises a plurality of springs. A first cover is configured to be positioned over the coil pack. The first cover is configured to be attached to the chassis by a first zipper. A comfort layer is configured to be positioned over the first cover. The comfort layer is configured to be attached to the chassis by a second zipper. A second cover is configured to be positioned over the comfort layer. The second cover is configured to be attached to the chassis by a third zipper.

In one embodiment, in accordance with the principles of the present disclosure, the fan is configured to create positive pressure to move air and/or moisture in the fan box layer through the support assembly, the first cover, the comfort layer and the second cover.

In one embodiment, in accordance with the principles of the present disclosure, the fan is configured to create negative pressure to move air and/or moisture adjacent to the second cover through the second cover, the comfort layer, the first cover, the support assembly and into the fan box layer.

In one embodiment, in accordance with the principles of the present disclosure, a bedding system is provided that includes a fan box layer comprising a fan and a fan port. The fan is configured to move air out of one of the fan port. A support assembly is positioned on top of the fan box layer and includes a spacer and a coil pack comprising a plurality of springs. The support assembly comprises an encasement that surrounds the spacer and the coil pack. The encasement includes an aperture that is in communication with the fan port. A comfort layer is positioned over the first cover. A cover is positioned over the comfort layer.

In one embodiment, in accordance with the principles of the present disclosure, the fan is configured to create positive pressure to move air and/or moisture in the fan box layer through the support assembly, the comfort layer and the cover.

In one embodiment, in accordance with the principles of the present disclosure, the fan is configured to create negative pressure to move air and/or moisture adjacent to the cover through the cover, the comfort layer, the support assembly and into the fan box layer.

In one embodiment, in accordance with the principles of the present disclosure, the support assembly is attached to a housing of the fan box layer by a zipper.

In one embodiment, in accordance with the principles of the present disclosure, the comfort layer is attached to a housing of the fan box layer by a zipper.

In one embodiment, in accordance with the principles of the present disclosure, the cover is attached to a housing of the fan box layer by a zipper.

In one embodiment, in accordance with the principles of the present disclosure, the fan comprises a plurality of fans, the fan port comprises a plurality of fan ports, and the aperture comprises a plurality of apertures.

In one embodiment, in accordance with the principles of the present disclosure, the encasement is a plastic bag.

In one embodiment, in accordance with the principles of the present disclosure, the encasement comprises a permeable material.

In one embodiment, in accordance with the principles of the present disclosure, the spacer comprises a platform that is supported by legs, the platform comprising a metal grill.

In one embodiment, in accordance with the principles of the present disclosure, the fan is connected to the fan port by a duct.

In one embodiment, in accordance with the principles of the present disclosure, the fan box layer comprises a tambour coupled to a housing of the fan box layer, the fan port extending through the tambour.

In one embodiment, in accordance with the principles of the present disclosure, a bedding system is provided that includes a chassis comprising a bottom wall, opposite first and second side walls extending upwardly from the bottom wall and opposite first and second end walls extending upwardly from the bottom wall. The walls define a cavity. The walls are each configured to prevent air flow therethrough. One of the walls includes a port extending through the thickness thereof that is in communication with the cavity. A support assembly is positioned in the cavity and includes a spacer and a coil pack comprising a plurality of springs. A first cover is positioned over the support assembly. A comfort layer is positioned over the first cover. A second cover is positioned over the comfort layer. A pressure generator comprises a tube having a first end that extends through the port and a second end that is coupled to a fan of the pressure generator.

In one embodiment, in accordance with the principles of the present disclosure, the pressure generator is configured to create positive pressure that moves air and/or moisture within the pressure generator through the support assembly, the first cover, the comfort layer and the second cover.

In one embodiment, in accordance with the principles of the present disclosure, the pressure generator is configured to create negative pressure that moves air and/or moisture adjacent to the second cover, through the second cover, the comfort layer, the first cover, the support assembly and into the pressure generator.

In one embodiment, in accordance with the principles of the present disclosure, the walls each comprise a material that is impervious to air flow therethrough.

In one embodiment, in accordance with the principles of the present disclosure, the walls are each coated with a material that is impervious to air flow therethrough.

In one embodiment, in accordance with the principles of the present disclosure, the comfort layer comprises a plurality of spaced apart channels that extend completely through an entire thickness of the comfort layer. In one embodiment, in accordance with the principles of the present disclosure, the channels are formed but cutting holes in a base material that forms the comfort layer. In one embodiment, in accordance with the principles of the present disclosure, the channels are larger in diameter than any pores inherently present in a base material that forms the comfort layer. In one embodiment, in accordance with the principles of the present disclosure, the channels are uniformly spaced apart from one another. In one embodiment, in accordance with the principles of the present disclosure, the channels each have a uniform shape, size and diameter.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
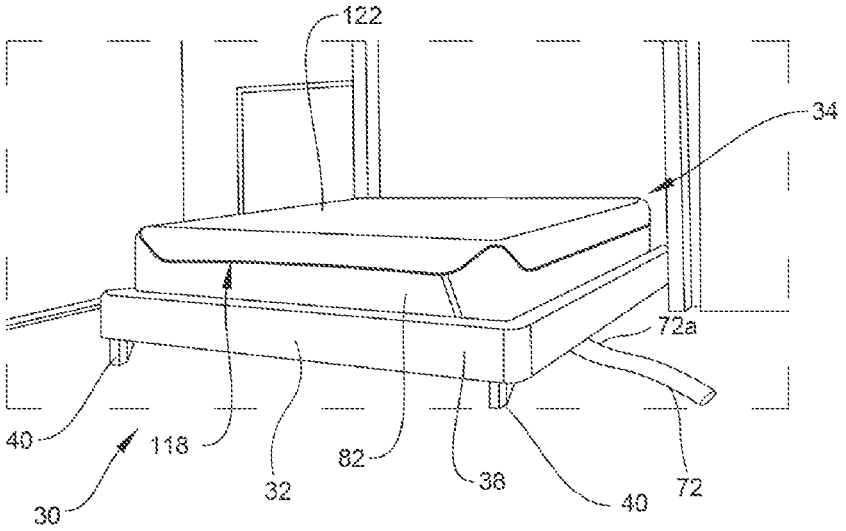
FIG. 1 is a perspective view of one embodiment of a bedding system, in accordance with the principles of the present disclosure.
Figure 2:
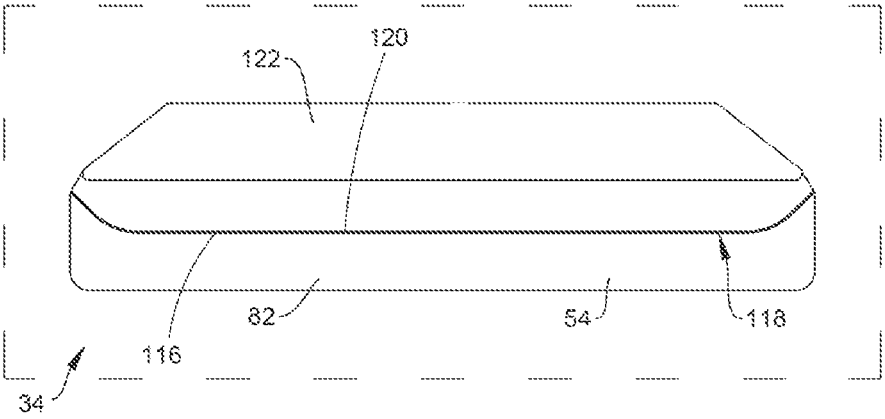
FIG. 2 is a perspective view of components of the bedding system shown in FIG. 1.
Figure 3:
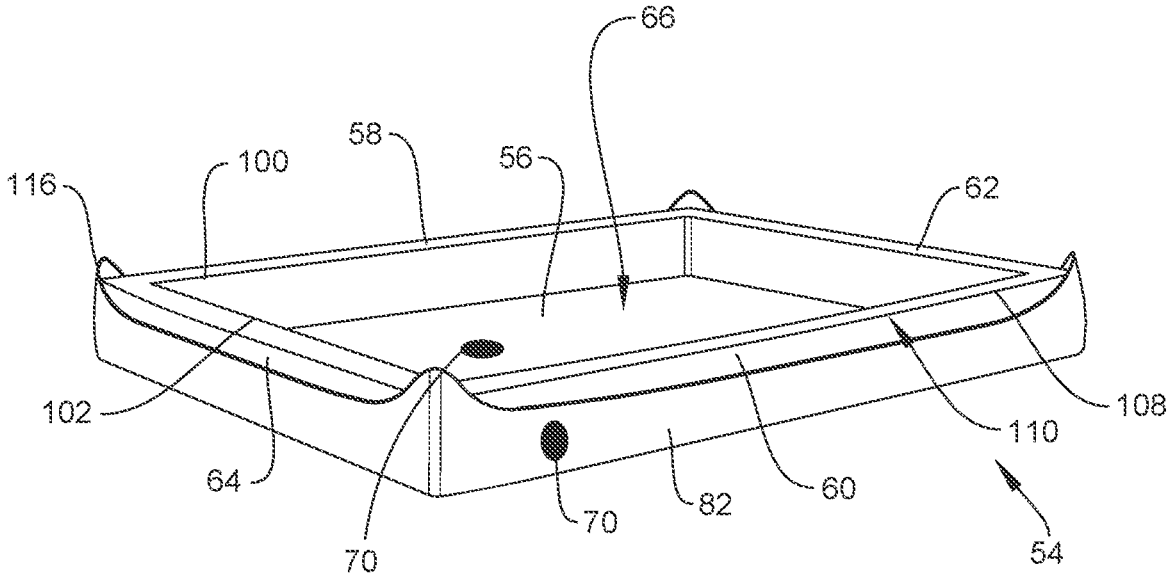
FIG. 3 is a perspective view of a component of the bedding system shown in FIG. 1.
Figure 4:
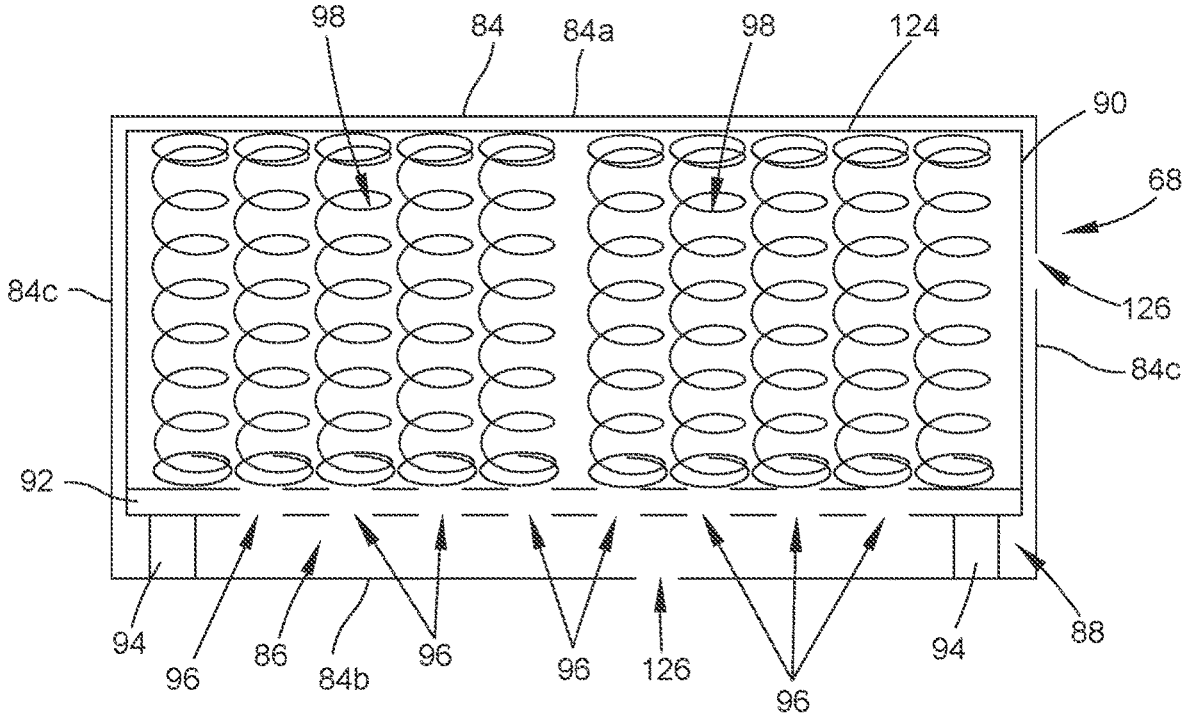
FIG. 4 is a side, cross-sectional view of a component of the bedding system shown in FIG. 1.
Figure 5:
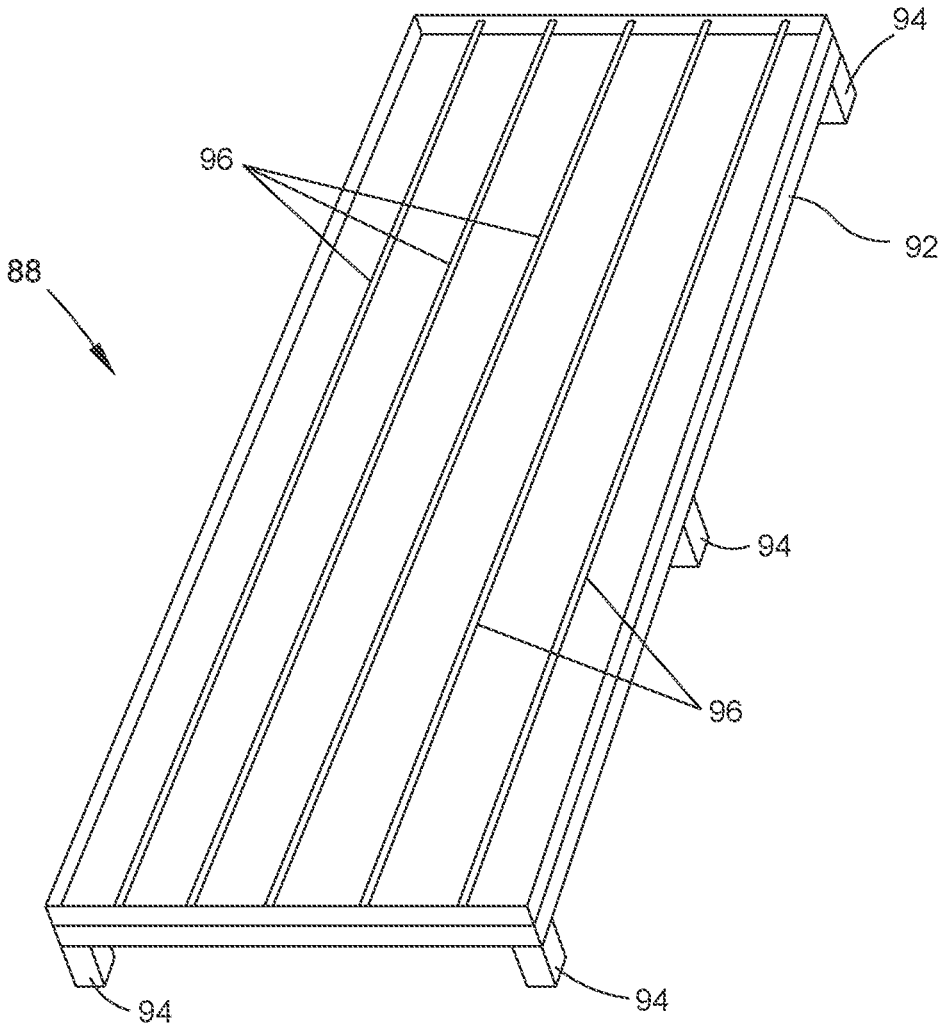
FIG. 5 is a perspective view of a component of the bedding system shown in FIG. 1.

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

In some embodiments, the bedding system disclosed herein includes a mattress assembly that includes a support assembly having a bag, such as, for example, an encasement. A spacer and coil pack are positioned in the encasement. In some embodiments, the bedding system includes a single encasement. In some embodiments, the bedding system includes a plurality of encasements that are separate from one another. The encasement includes one or a plurality of ports for a fan to enter the encasement. In some embodiments, the fan provides positive air. In some embodiments, the fan provides negative air. In some embodiments, the fan provides both positive and negative air. In some embodiments, the support assembly consists of the encasement, the spacer and the coil pack. That is, only the spacer and the coil pack are positioned within the encasement. In some embodiments, the fan includes a fan box having a heater, such as, for example, a thermoelectric device positioned therein.

In some embodiments, the bedding system includes a comfort layer positioned on top of the encasement such that the comfort layer is positioned over the coil pack(s). In some embodiments, the comfort layer is perforated for air flow. In some embodiments, the comfort layer is zippered down to a frame, such as, for example, a chassis. In some embodiments, the comfort layer includes a heater, such as, for example, a thermoelectric device positioned therein. In some embodiments, the bedding system includes a heater, such as, for example, a thermoelectric device positioned in a separate layer between the comfort layer and a top cover.

In some embodiments, the bedding system disclosed herein includes a mattress assembly that includes a base, such as, for example, a fan box having one or more fans. In one embodiment, the fan box includes at least one fan on each side of the fan box. In one embodiment, the fan box includes at least one fan on a central location of the fan box. In some embodiments, a tambour is positioned on top of the fan box. A support assembly is positioned on top of the tambour or the fan box. The support assembly includes a bag, such as, for example, an encasement having a spacer and a coil pack positioned therein. In some embodiments, the spacer separates the coil pack from the fan(s). In some embodiments, the encasement is a sealed plastic bag with a permeable or super permeable top. In some embodiments, the spacer comprises a metal grille with a certain height. In some embodiments, the encasement includes one or a plurality of ports that connect to fan ports in the fan box. The mattress assembly includes a comfort layer, such as, for example, a foam topper that is positioned on top of the support assembly. In some embodiments, the foam topper is perforated. In some embodiments, the foam topper may use a super permeable cover to hold multi-layered contents. The mattress assembly includes a cover that is positioned on top of the foam topper. In some embodiments a resistive heater is positioned between the foam topper and the cover. In some embodiments, a first resistive heater is positioned between the foam topper and the cover on a first side of the mattress assembly and a second resistive heater is positioned between the foam topper and the cover on a second side of the mattress assembly. In some embodiments, the cover is zipped with another component of the mattress assembly, such as, for example, the fan box or the support assembly. In some embodiments, the cover is permeable to allow humidity and sweat to be sucked from a sleeper who is lying on the mattress assembly.

In some embodiments, the spacer creates an air chamber and/or air channels to allow air to move from fans through coil packs. In some embodiments, the support assembly includes only the coil pack(s) to create air channels as well as reduce weight and cost. That is, in some embodiments, the support assembly does not include the encasement or the spacer. In some embodiments, the comfort layer includes a first layer comprising a first memory foam, a second layer comprising a second memory foam, and a third layer comprising micro-coils. In some embodiments, the first memory foam is softer than the second memory foam. In some embodiments, the layers are glued together and around. In some embodiments, the comfort layer includes a first layer comprising a first memory foam and a second layer comprising a second memory foam in place of or in addition to the layers discussed hereinabove, wherein the memory foams are both perforated. In some embodiments, the comfort layer includes a first layer comprising a super soft memory foam, a second layer comprising a middling memory foam and a third layer comprising a super hard foam in place of or in addition to the layers discussed hereinabove, wherein the foams are all perforated. In some embodiments, the support assembly includes a single encasement having one spacer and one coil pack positioned therein. In some embodiments, the support assembly includes a single encasement having a plurality of spacers and a plurality of coil packs positioned therein.

In some embodiments, the mattress assembly includes a spacer that includes and/or creates air channels. The mattress assembly is configured to optimize vertical air flow. In some embodiments, the mattress assembly includes a hot/cold layer at a top. In some embodiments, the hot/cold layer includes resistant coils. In some embodiments, the mattress assembly includes an improved comfort layer. In some embodiments, the mattress assembly is configured to optimize humidity removal from a sleep surface, such as, for example, a top surface of a top or outer cover. In some embodiments, the mattress assembly includes a novel fan/plastic bag connection. In some embodiments, the mattress assembly provides an improved mattress combination.

As used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a bedding system in accordance with the principles of the present disclosure. Alternate embodiments are also disclosed. Reference will now be made in detail to the exemplary embodiments of the present disclosure, which are illustrated in the accompanying figures. Turning to FIGS. 1-20, there are illustrated components of a bedding system 30.

System 30 includes a foundation 32 and a mattress assembly 34 that is configured to sit on top of foundation 32 to position a sleep surface 36 of mattress assembly 34 a selected height above a floor of a room. In some embodiments, foundation 32 includes a platform 38 and one or a plurality of legs 40 positioned below platform 38. In some embodiments, mattress assembly 34 is removably coupled to foundation 32 such that mattress assembly 34 can be removed from foundation 32 to clean within a cavity of platform 38, for example. In some embodiments, mattress assembly 34 is permanently fixed to foundation 32 to prevent unintended movement of mattress assembly 34 relative to foundation 32. In some embodiments, mattress assembly 34 can be variously connected with foundation 32, such as, for example, monolithic, integral connection, frictional engagement, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

Mattress assembly 34 includes a chassis 54 comprising a bottom wall 56, a side wall 58, a side wall 60 opposite wall 58, an end wall 62 and an end wall 64 opposite wall 62. In some embodiments, wall 56 defines a tambour that is removable from walls 58, 60, 62, 64. Wall 58 extends parallel to wall 60 and wall 62 extends parallel to wall 64. In some embodiments, walls 58, 60 each extend perpendicular to walls 62, 64. Walls 58, 60, 62, 64 each extend upwardly from wall 56. In some embodiments, walls 56, 58, 60, 62, 64 define a body of chassis 54. A top surface of wall 56, an inner surface of wall 58, an inner surface of wall 60, an inner surface of wall 62 and an inner surface of wall 64 define a cavity 66 configured for disposal of a component of mattress assembly 34, such as, for example, one or more support assemblies 68, as discussed herein. In some embodiments, cavity 66 has a size and shape that is configured to match the size and shape of support assembly 68 to prevent relative movement of support assembly 68 relative to chassis 54 when support assembly 68 is positioned within cavity 66, as discussed herein. In some embodiments, cavity 66 is variously shaped, such as, for example, circular, oval, oblong, triangular, rectangular, square, polygonal, irregular, uniform, non-uniform, offset, staggered, undulating, arcuate, variable and/or tapered.

In some embodiments, chassis 54 is compressible to allow chassis to be rolled and/or folded. That is, chassis 54 is configured to move from a rolled and/or folded configuration to an unrolled and/or unfolded configuration. This allows chassis 54 to be positioned in a container, such as, for example, a cardboard box when chassis 54 is in the rolled and/or folded configuration. Chassis 54 is removed from the box while chassis is in the rolled and/or folded configuration. Chassis 54 is then placed on a surface, such as, for example, platform 38 and is moved from the rolled and/or folded configuration to the unrolled and/or unfolded configuration. In some embodiments, wall 56 is made from a fabric material and walls 58, 60, 62, 64 are each made from a compressible material, such as, for example, foam. In some embodiments, the foam is memory foam, latex foam, or another compressible and/or breathable foam. In some embodiments, walls 58, 60, 62, 64 each consist of foam. That is, wall 58 consists of memory foam from surface 58*a* to an opposite outer surface 58*b* of wall 58; wall 60 consists of memory foam from surface 60*a* to an opposite outer surface 60*b* of wall 60; wall 62 consists of memory foam from surface 62*a* to an opposite outer surface 62*b* of wall 62; and wall 64 consists of memory foam from surface 64*a* to an opposite outer surface 64*b* of wall 64. In some embodiments, walls 58, 60, 62, 64 are each made of one or more materials and are each homogeneous along the entire thicknesses and heights thereof.

In some embodiments, walls 58, 60, 62, 64 are each free of any hard and/or rigid material, such as, for example, metal, plastic and wood to allow chassis 54 to move between the rolled and/or folded configuration and the unrolled and/or unfolded configuration. In some embodiments, walls 58, 60, 62, 64 are each free of any hinges or joints. Indeed, chassis 54 relies upon the material that forms walls 58, 60, 62, 64, rather than hinges or joints, to move chassis 54 between the rolled and/or folded configuration and the unrolled and/or unfolded configuration. In some embodiments, at least one of walls 58, 60, 62, 64 includes a plurality of spaced apart divots or notches to facilitate rolling of chassis 54.

In some embodiments, chassis 54 includes one or more holes, such as, for example, fan holes 70 configured for disposal of structure, such as, for example a tube 72 that is connected to a pressure generator 74 of bedding system 30 to force air and/or moisture to surface 36 and/or pull air and/or moisture away from surface 36, as discussed herein. It is envisioned that fan holes 70 can be variously positioned about chassis 54. For example, in one embodiment, chassis 54 includes a fan hole 70 extending through a thickness of wall 56. In some embodiments, chassis 54 includes a fan hole 70 extending through a thickness of wall 60. However, it is envisioned that chassis 54 may include one or more fan holes 70 in wall 56, wall 58, wall 60, wall 62 and/or wall 64.

In some embodiments, wall 56 consists of a fabric material. In some embodiments, the fabric material is breathable to allow air and/or moisture to move through a thickness of wall 56. In some embodiments, wall 56 is highly porous. In some embodiments, wall 56 includes pores that are greater than 0.5 microns. In some embodiments, wall 56 includes pores that are greater than 3.0 microns. In some embodiments, wall 56 includes pores that are greater than 10.0 microns. In some embodiments, wall 56 is free of any hard and/or rigid material, such as, for example, metal, plastic and wood to allow chassis 54 to move between the rolled and/or folded configuration and the unrolled and/or unfolded configuration. In some embodiments, wall 56 is free of any hinges or joints. Indeed, chassis 54 relies upon the material that forms wall 56, rather than hinges or joints to move chassis 54 between the rolled and/or folded configuration and the unrolled and/or unfolded configuration.

In some embodiments, chassis 54 includes a jacket 82 that is coupled to outer surfaces of walls 58, 60, 62, 64. Jacket 82 defines an outermost surface of chassis 54. That is, walls 58, 60, 62, 64 are each positioned within jacket 82 such that outer surfaces of walls 58, 60, 62, 64 directly engage an inner surface of jacket 82. In some embodiments, jacket 82 is made from a breathable material, such as, for example, AIR-X®, manufactured by Bedgear, LLC of Farmingdale, New York, to provide ventilation inside and out of chassis 54 and enhanced air flow that removes humidity and excess body heat from cavity 66. In some embodiments, jacket 82 is highly porous. In some embodiments, jacket 82 includes pores that are greater than 0.5 microns. In some embodiments, jacket 82 includes pores that are greater than 3.0 microns. In some embodiments, jacket 82 includes pores that are greater than 10.0 microns. In some embodiments, jacket 82 has a porosity that is greater than a porosity of walls 58, 60, 62, 64. In some embodiments, chassis 54 is configured to have air and/or moisture in cavity 66 move through walls 58, 60, 62, 64 and jacket 82.

Chassis 54 includes one or a plurality of fasteners, such as, for example, zippers to connect other components of mattress assembly 34 with chassis 54, as discussed herein. In some embodiments, chassis 54 includes a row of teeth 100 of a zipper 102. Teeth 100 extend along walls 58, 60, 62, 64 and are configured to engage and/or interdigitate with a row of teeth 104 of a component of system 30, such as, for example, a cover 106 to attach cover 106 to chassis 54, as discussed herein. Teeth 104 are part of zipper 102 and may be moved relative to teeth 100 using a slider of zipper 102 such that teeth 104 engage and/or interdigitate with teeth 100. In some embodiments, teeth 100 extend continuously about the entire perimeter of cavity 66. In some embodiments, cover 106 can be variously connected with chassis 54, such as, for example, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

In some embodiments, cover 106 includes a suspension fabric that covers support assembly 68. Cover 106 may be formed from one or more of the materials discussed herein. In some embodiments, cover 106 comprises a breathable material that allows air and/or moisture to move in and outer of cavity 66 through cover 106. In some embodiments, cover 106 is highly porous. In some embodiments, cover 106 includes pores that are greater than 0.5 microns. In some embodiments, cover 106 includes pores that are greater than 3.0 microns. In some embodiments, cover 106 includes pores that are greater than 10.0 microns. In some embodiments, cover 106 has a porosity that is less than a porosity of walls 58, 60, 62, 64 such that air and/or moisture in cavity 66 will exit cavity 66 through walls 58, 60, 62, 64 instead of cover 106. That is, air and/or moisture in cavity 66 will move out of cavity 66 through walls 58, 60, 62, 64 before any air and/or moisture moves through cover 106. In some embodiments, cover 106 has a porosity that is greater than a porosity of walls 58, 60, 62, 64 such that air and/or moisture in cavity 66 will exit cavity through cover 106 instead of walls 58, 60, 62, 64. That is, air and/or moisture in cavity 66 will move out of cavity 66 through cover 106 before any air and/or moisture moves through walls 58, 60, 62, 64.

In some embodiments, chassis 54 includes a row of teeth 108 of a zipper 110. Teeth 108 extend along walls 58, 60, 62, 64 and are configured to engage and/or interdigitate with a row of teeth 112 of a component of system 30, such as, for example, a comfort layer 114 to attach comfort layer 114 to chassis 54, as discussed herein. Teeth 112 are part of zipper 110 and may be moved relative to teeth 108 using a slider of zipper 110 such that teeth 112 engage and/or interdigitate with teeth 108. In some embodiments, teeth 108 extend continuously about the entire perimeter of teeth 100. That is, teeth 100 define a perimeter that is enclosed within a perimeter defined by teeth 108. In some embodiments, comfort layer 114 can be variously connected with chassis 54, such as, for example, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

In some embodiments, comfort layer 114 is similar to a mattress topper and is configured to be positioned on top of cover 106 such that a bottom surface of comfort layer 114 directly engages a top surface of cover 106. In some embodiments, comfort layer 114 includes a cushion or cushioning material to provide cushioning to the sleeper(s) that lie on top of comfort layer 114. In some embodiments, comfort layer 114 includes a plurality of spaced apart perforations, such as, for example, channels 115 that extend completely through the entire thickness of comfort layer 114. In some embodiments, channels 115 are formed but cutting holes in a base material that forms comfort layer 114. Channels 115 increase the breathability of comfort layer 114 to increase the rate of flow of air and/or moisture through comfort topper 114. Comfort layer 114 is removeably coupled to chassis 54 to allow comfort layer 114 to be removed from chassis 54 for cleaning or to replace comfort layer 114 with a new comfort layer 114, as discussed herein. For example, if the sleeper desires a mattress that is firmer, comfort layer 114 can be removed from chassis 54 by unzipping zipper 110. Comfort layer 114 can then be replaced with a comfort layer 114 that is firmer. In some embodiments, comfort layer 114 can be a mat, a mattress topper or a mattress. It is envisioned that comfort layer 114 can have various thicknesses. For example, comfort layer 114 can have a thickness that is less than 1 inch, a thickness that is greater than 3 inches or any thickness between 0.1 inches and 12 inches.

In some embodiments, chassis 54 includes a row of teeth 116 of a zipper 118. Teeth 116 extend continuously along an upper edge of jacket 82 and are configured to engage and/or interdigitate with a row of teeth 120 of a component of system 30, such as, for example, a top cover 122 to attach cover 122 to chassis 54, as discussed herein. Teeth 120 are part of zipper 118 and may be moved relative to teeth 116 using a slider of zipper 118 such that teeth 120 engage and/or interdigitate with teeth 116. In some embodiments, teeth 116 extend continuously about the entire perimeter of teeth 108. That is, teeth 108 define a perimeter that is enclosed within a perimeter defined by teeth 116. In some embodiments, teeth 116 extend continuously along an entire perimeter of jacket 82. Since jacket 82 is positioned outside of walls 58, 60, 62, 64, the perimeter defined by walls 58, 60, 62, 64 is enclosed within the perimeter defined by jacket 82. In some embodiments, cover 122 can be variously connected with chassis 54, such as, for example, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

Surface 36 is defined by a top surface of cover 122. Cover 122 is configured to couple comfort layer 114 to chassis 54 such that comfort layer 114 is prevented from shifting relative to chassis 54. Cover 122 includes a bottom surface 128 opposite surface 36. In some embodiments, cover 122 is made from a fabric material, such as, for example, a spandex material. That is, the fabric material of cover 122 defines a base material of cover 122.

As discussed above, one or a plurality of support assemblies 68 is/are configured for disposal within cavity 66. Support assembly 68 includes a bag, such as, for example, an encasement 84 that defines a recess 86 having a spacer 88 and a coil pack 90 positioned therein. Spacer 88 includes a platform 92 that is supported by a plurality of legs 94. Spacer 88 is configured to increase the amount of air within recess 86 to facilitate moving air and/or moisture in and out of recess 86 using pressure generator 74. Indeed, it has been found that increasing the amount of air within recess 86 reduces the amount of pressure that is needed to move air and/or moisture in and out of recess 86 using pressure generator 74. This will allow pressure generator 74 to operate at a lower power and/or a lower speed, which will decrease the amount of noise created by pressure generator 74. Coil pack 90 is configured to sit on top of platform 92. In some embodiments, platform 92 is configured as a grate, such as, for example a metal grille. That is, platform 92 may include one or a plurality of apertures 96 that extend through a thickness of platform 92 to allow air and/or moisture within recess 86 below platform 92 to move through platform 92 and into coil pack 90 and/or to allow air and/or moisture in coil pack 90 to move through platform 92 to an area within recess 86 below platform 92. In some embodiments, apertures 96 are spaced apart from one another and each extend the entire length of platform 92, as shown in FIG. 6.

Encasement 84 includes a top wall 84*a*, a bottom wall 84*b* opposite wall 84*a* and one or a plurality of side walls 84*c* that each extend rom wall 84*a* to wall 84*b*. Walls 84*c* define the entire perimeter of encasement 84. In some embodiments, walls 84*b*, 84*c* are impermeable and/or non-porous and wall 84*a* is permeable and/or porous to allow air and/or moisture in recess 86 to move through wall 84*a*, cover 106, comfort layer 114 and cover 122 and/or allow air and/or moisture adjacent to surface 56 to move through cover 122, comfort layer 114, cover 106 and into recess 86 through wall 84*a*, as discussed herein. In some embodiments, walls 84*b*, 84*c* are completely impervious to air flow therethrough. That is, walls 84*b*, 84*c* define a barrier that does not allow air to move from one side of the barrier to the other side of the barrier. In some embodiments, wall 84*a* includes a plurality of spaced apart openings that are cut into a base material that forms wall 84*a* to provide enhanced air flow through wall 84*a*. In some embodiments, the openings in wall 84*a* are larger than any pores inherently present in the base material that forms wall 84*a*. In some embodiments, walls 84*b*, 84*c* are porous and are laminated and/or coated with a material, such as, for example, plastic to make walls 84*b*, 84*c* completely resistant to air flow therethrough.

Coil pack 90 includes a plurality of springs, such as, for example, coil springs 98. In some embodiments, springs 98 are uncovered such that first ends of springs 98 each directly engage platform 92 and an opposite second ends of springs 98 each directly engage encasement 84. In some embodiments, springs 98 are positioned in a pouch, such as, for example, a shell 124 such that a bottom surface of shell 124 directly engages platform 92 and an opposite top surface of shell 124 directly engages encasement 84 and shell 124 spaces springs 98 apart from platform 92 and encasement 84. In some embodiments, coil pack 90 includes one or a plurality of rows of springs 98 and one or a plurality of columns of springs 98. In some embodiments, coil pack 90 includes a plurality of strings of springs, as described in U.S. Patent Application No. 62/347,199 to the applicant of the current application, which is incorporated by reference herein, in its entirety. In some embodiments, springs 98 are each positioned within a pocket, such as, for example, a fabric pocket. The pockets may be coupled to one another to form a string of pockets that each include one of springs 98 therein. In some embodiments, the string of pockets includes one or more slits between adjacent pockets to allow springs 98 to move independently of one another. In some embodiments, the string of pockets includes one or more slits that extend through a top surface of the string of pockets between adjacent pockets and/or one or more slits that extend through a bottom surface of the string of pockets between adjacent pockets. In some embodiments, chassis 54 comprises a plurality of springs that are the same or similar to springs 98 that are disposed about a circumference of cavity 66 and fixed to at least one of walls 58, 60, 62, 64. Additional springs that are the same or similar to springs 98 may be positioned within the perimeter of springs. In embodiments wherein springs 98 are positioned in a pocket or a shell, it is envisioned that the pocket and/or shell be made from a breathable material that allows air and/or moisture to move through the pocket and/or the shell. This will allow air and/or moisture within recess 86 below platform 92 to move through platform 92 and the pocket and/or shell 124 and/or to allow air and/or moisture above coil pack 90 to move through the pocket and/or shell 124 and platform 92 to an area within recess 86 below platform 92.

Figure 6:
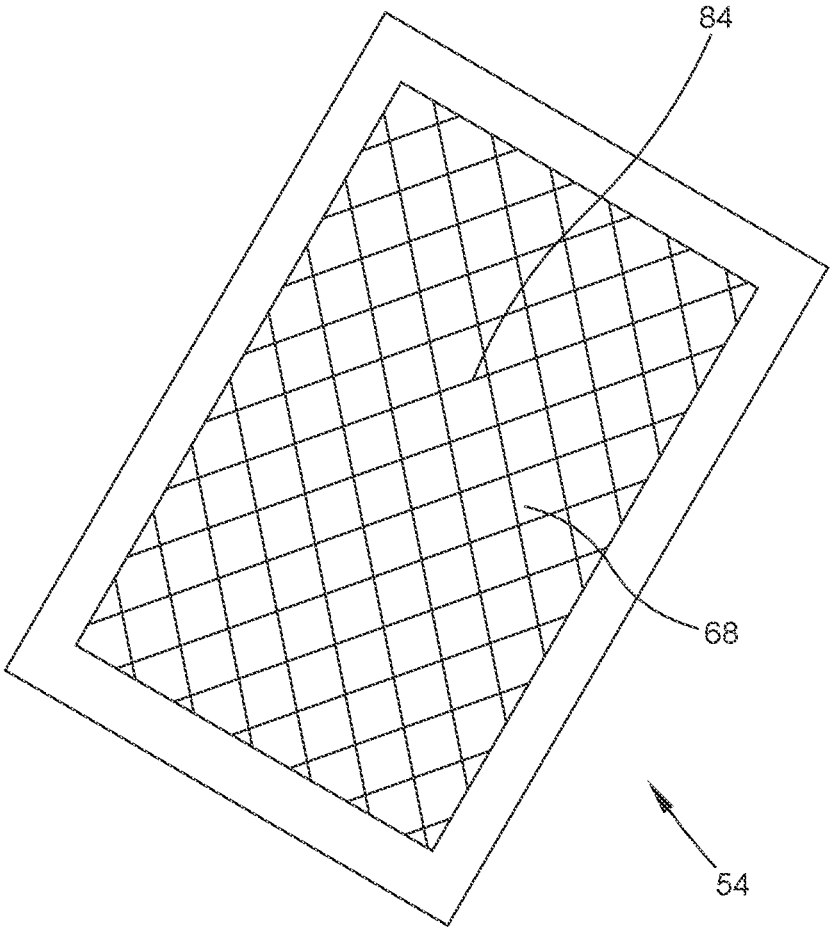
FIG. 6 is a perspective view of one embodiment of components of the bedding system shown in FIG. 1, in accordance with the principles of the present disclosure.
Figure 7:
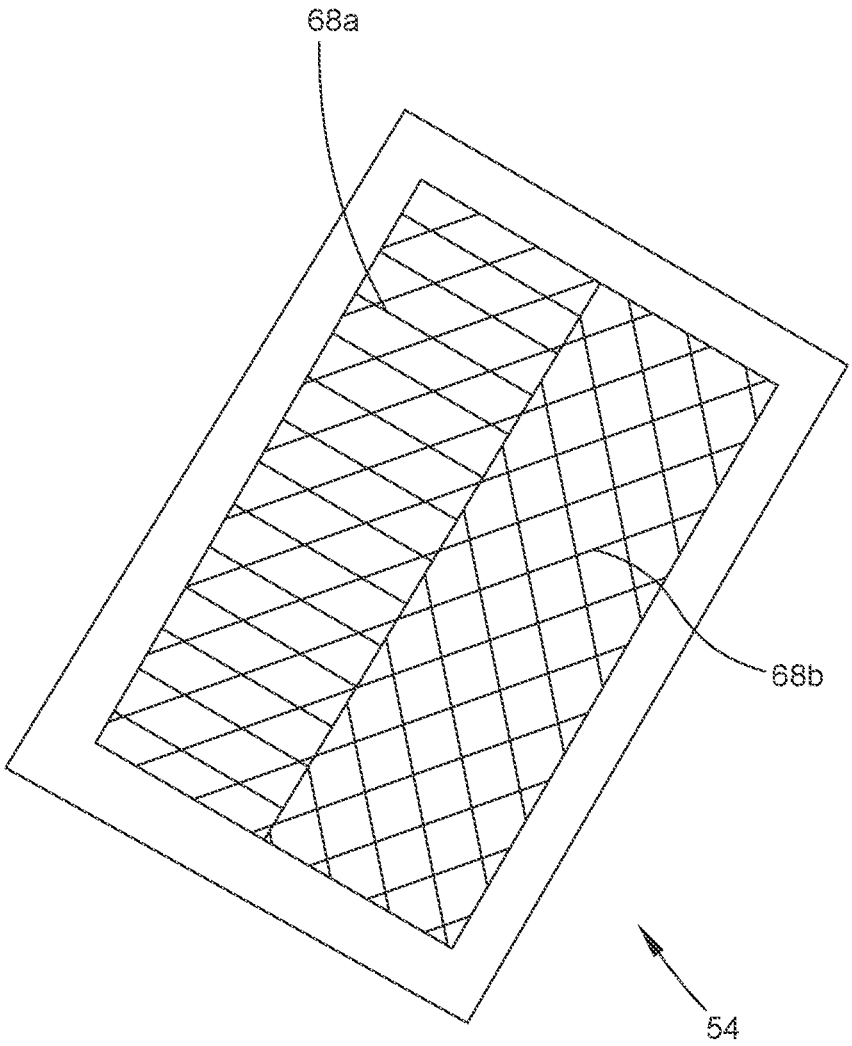
FIG. 7 is a perspective view of one embodiment of components of the bedding system shown in FIG. 1, in accordance with the principles of the present disclosure.
Figure 8:
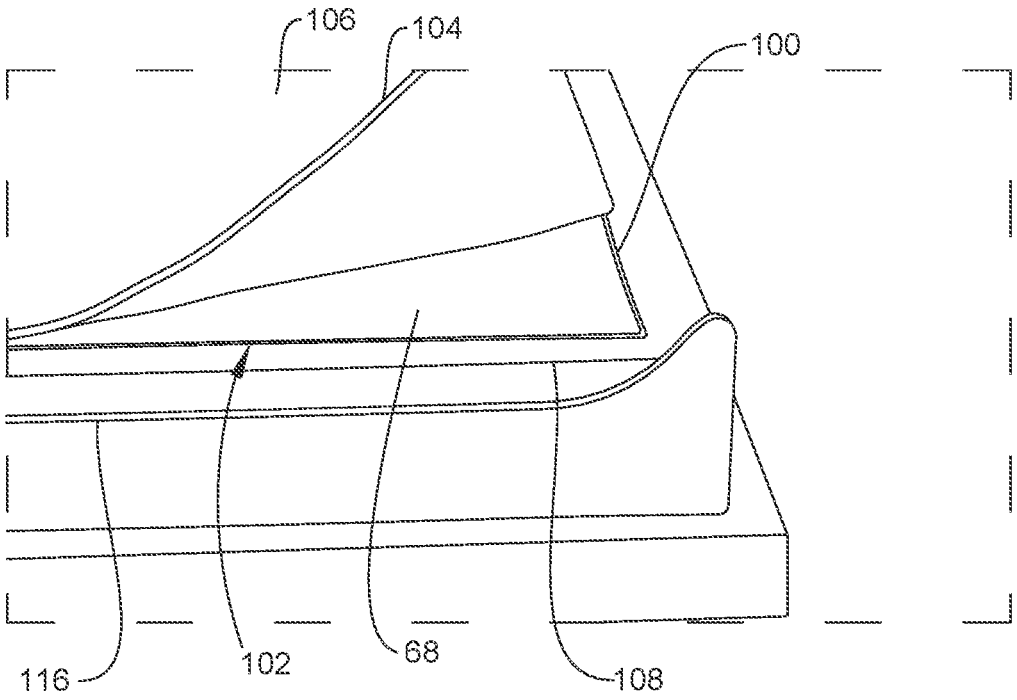
FIG. 8 is a perspective view of components of the bedding system shown in FIG. 1.
Figure 9:
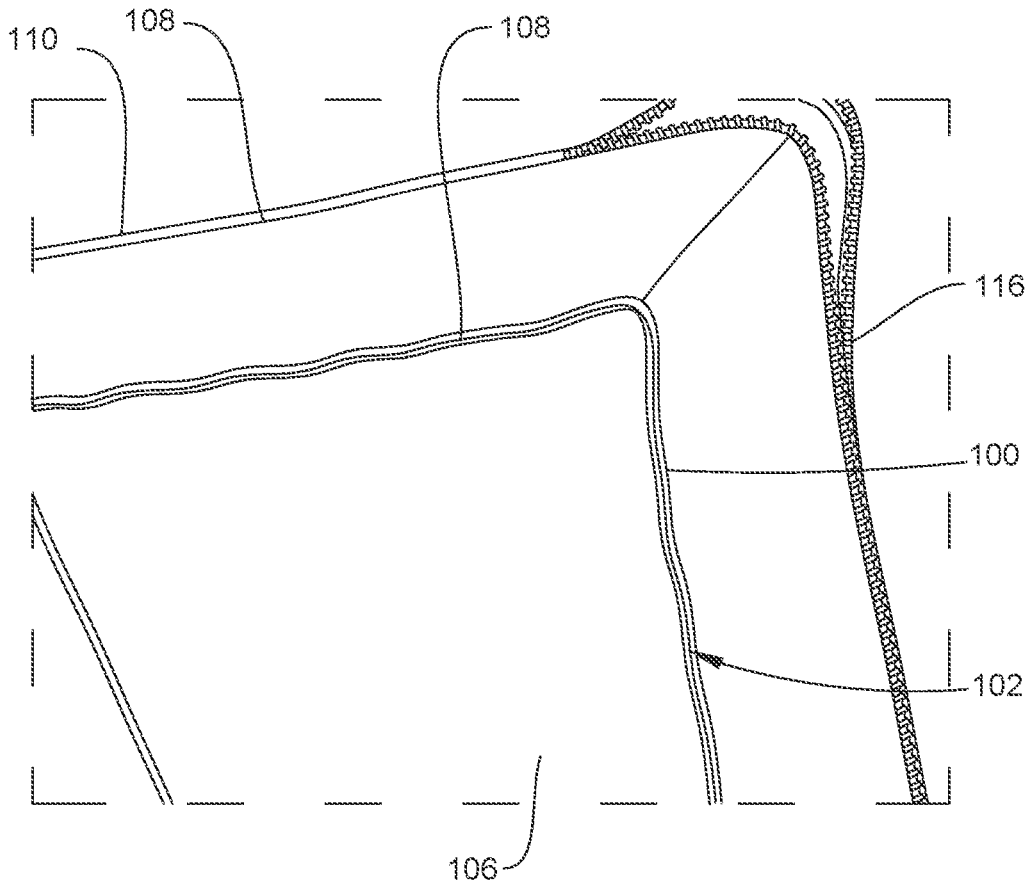
FIG. 9 is a top view of components of the bedding system shown in FIG. 1.
Figure 10:
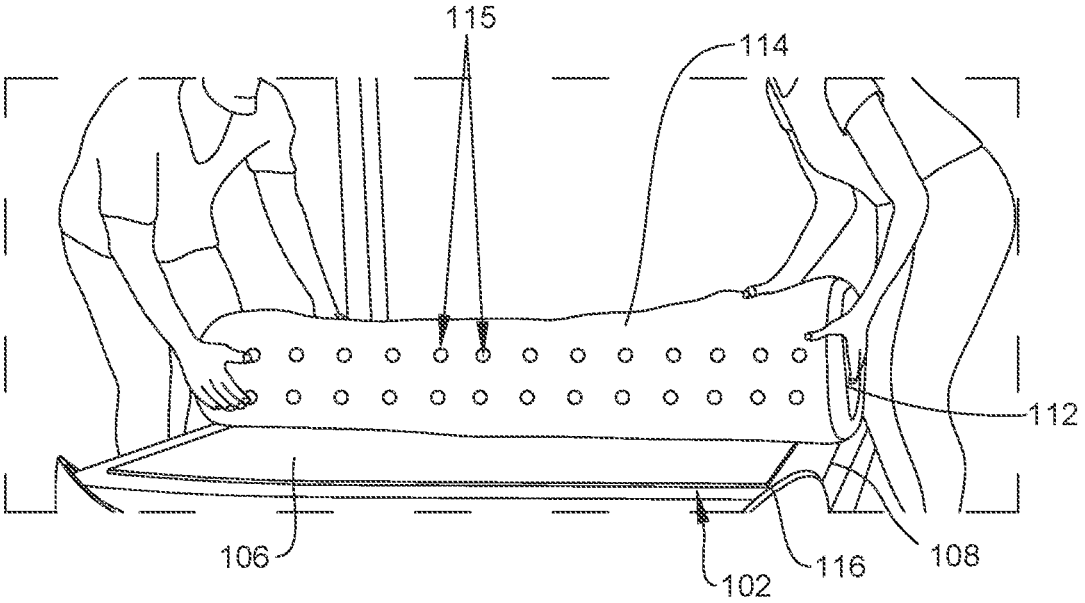
FIG. 10 is a perspective view of components of the bedding system shown in FIG. 1.
Figure 11:
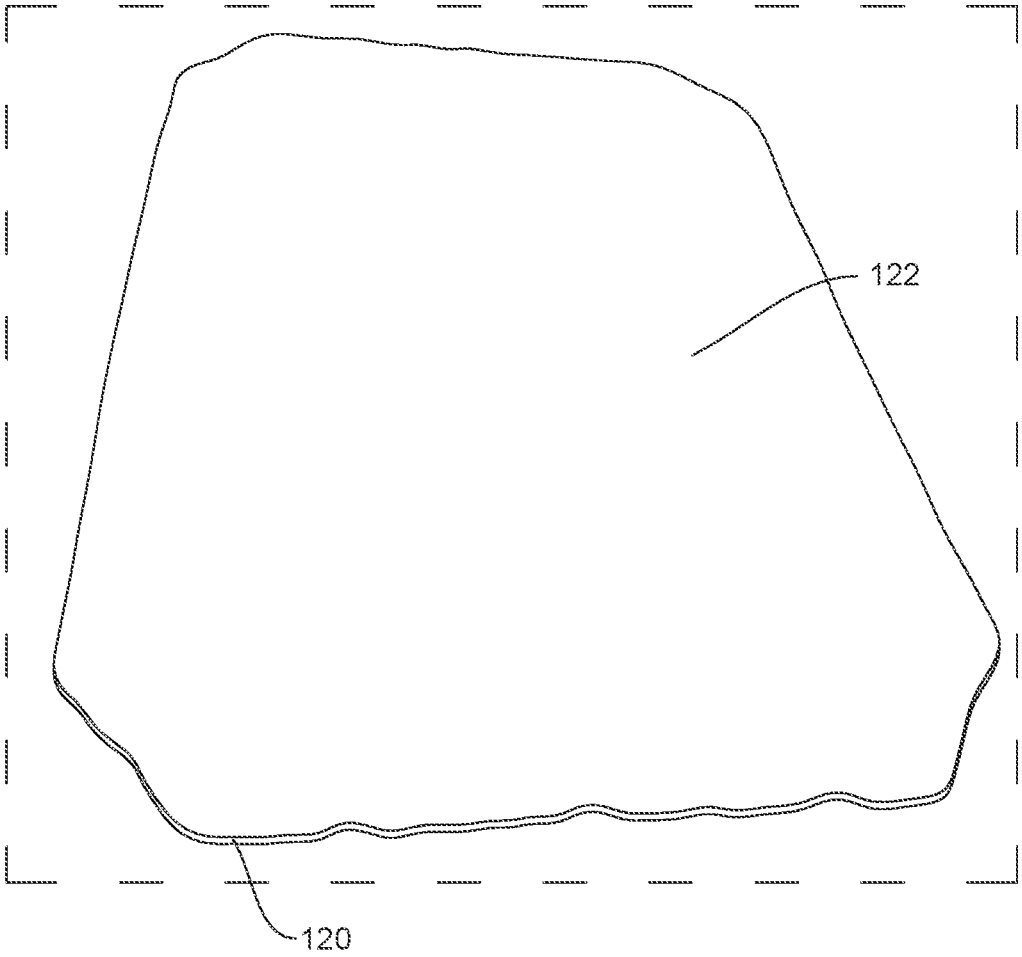
FIG. 11 is a perspective view of a component of the bedding system shown in FIG. 1.
Figure 12:
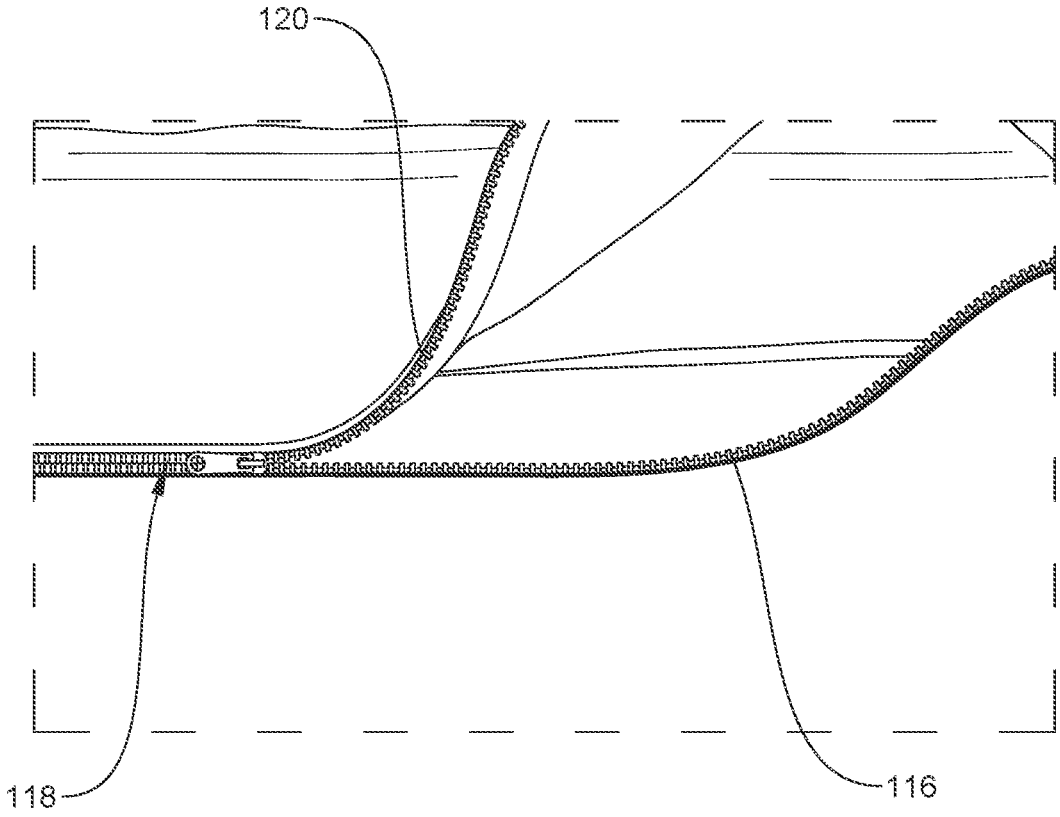
FIG. 12 is a side view of components of the bedding system shown in FIG. 1.
Figure 13:
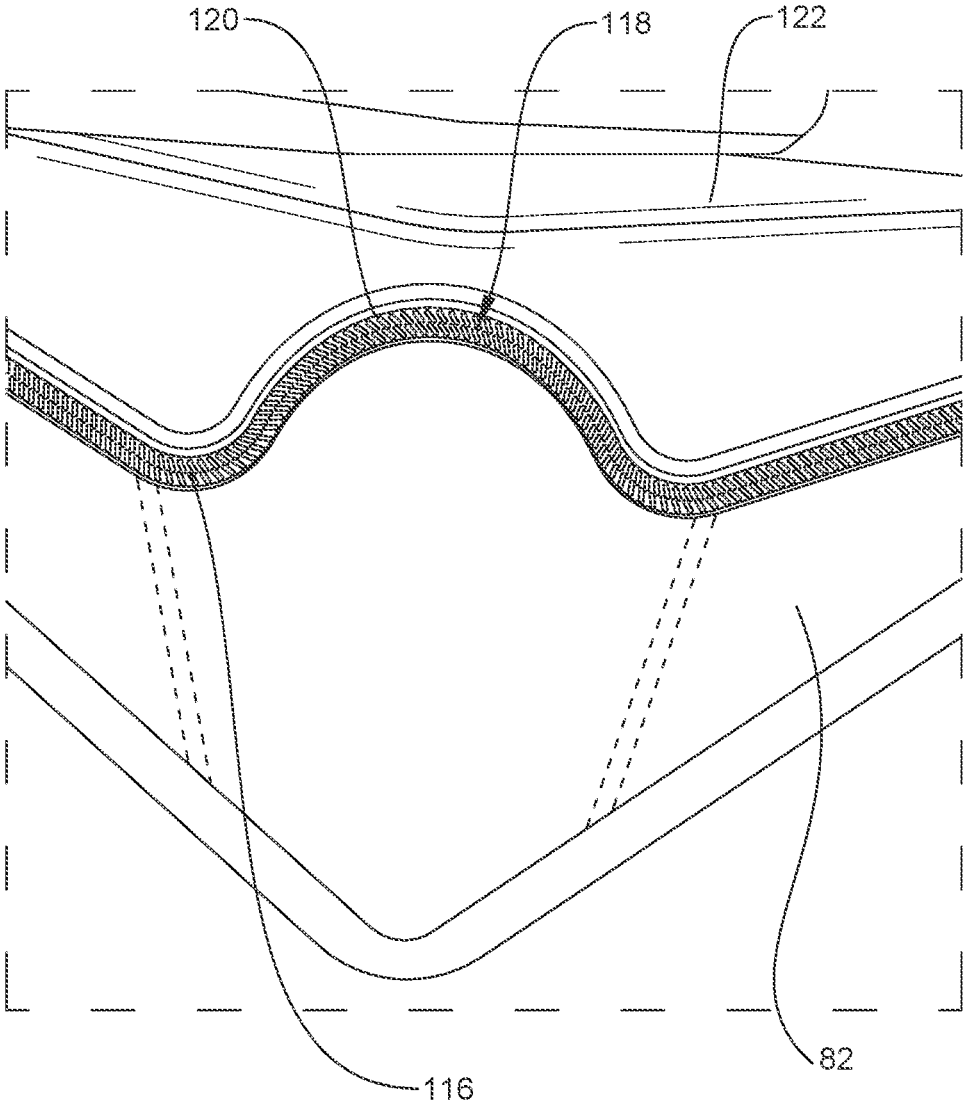
FIG. 13 is a side view of components of the bedding system shown in FIG. 1.

In some embodiments, mattress assembly 34 may include only one support assembly 68 that entirely fills cavity 66, as shown in FIG. 6. In some embodiments, mattress assembly 34 includes a first support assembly 68*a* and a second support assembly 68*b*, as shown in FIG. 7. In some embodiments, support assembly 68*a* is different than support assembly 68*b*. For example, in one embodiment, support assembly

68*a* has a firmness that is different than a firmness of support assembly 68*b*. This allows mattress assembly 34 to accommodate two different comfort preferences of two different sleepers. For example, if a sleeper who sleeps on the left side of the bed prefers a firmer mattress than a sleeper who sleeps on the right side of the bed, support assembly 68*a* can be provided with a firmness that is greater than a firmness of support assembly 68*b*. If, on the other hand, the sleeper who sleeps on the left side of the bed prefers a softer mattress than the sleeper who sleeps on the right side of the bed, support assembly 68*a* can be provided with a firmness that is less than a firmness of support assembly 68*b*. In some embodiments, springs 98 of support assembly 68*a* may include more or less coils than springs 98 of support assembly 68*b*. In some embodiments, springs 98 of support assembly 68*a* may include coils having a different gauge than the coils of springs 98 of support assembly 68*b*. In some embodiments, springs 98 of support assembly 68*a* may include different coils than the coils of springs 98 of support assembly 68*b*. For example, springs 98 of support assembly 68*a* may include continuous coils, bonnell coils, offset coils and marshall coils and support assembly 68*b* may include springs 98 having coils that are different than the coils of springs 98 of support assembly 68*a*. Using different springs 98 in support assembly 68*a* than support assembly 68*b* allows mattress assembly 34 to be customized based on preference. It is also envisioned that support assembly 68*a* and support assembly 68*b* can be identical to one another in both structure and performance.

In some embodiments, encasement 84 includes one or a plurality of openings, such as, for example, ports 126 that are in communication with recess 86. In some embodiments, encasement 84 includes one or a plurality of ports 126 that extend through a bottom surface of encasement 84, one or a plurality of ports 126 that extend through a side surface of encasement 84, one or a plurality of ports 126 that extend through an end surface of encasement 84 and/or one or a plurality of ports 126 that extend through a top surface of encasement 84. Tube 72 is configured to be positioned through one of holes 70 and one of ports 126, as discussed herein.

Figure 14:
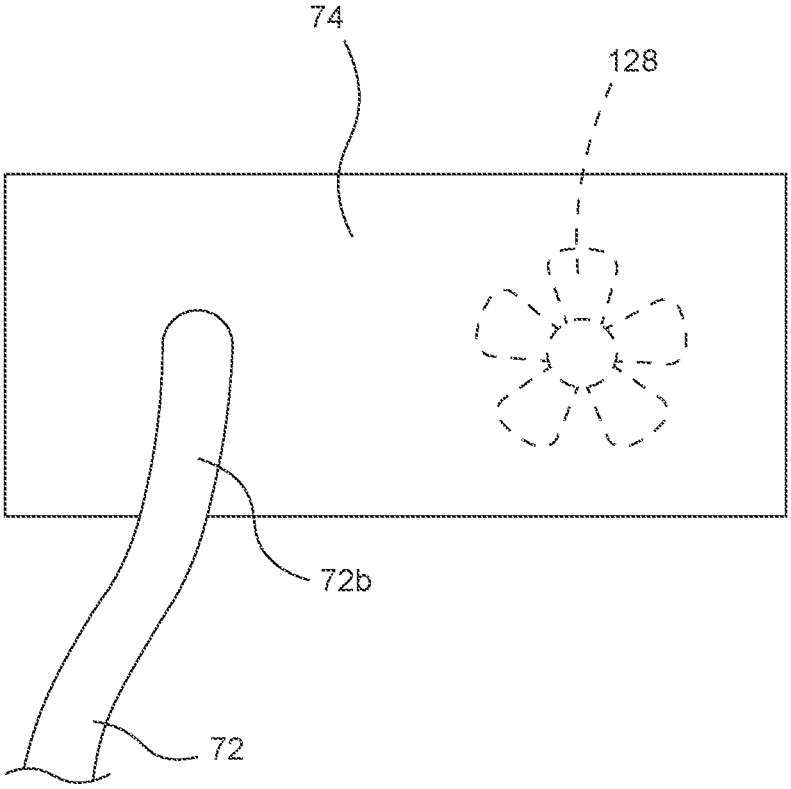
FIG. 14 is a perspective view, in part phantom, of components of the bedding system shown in FIG. 1.
Figure 15:
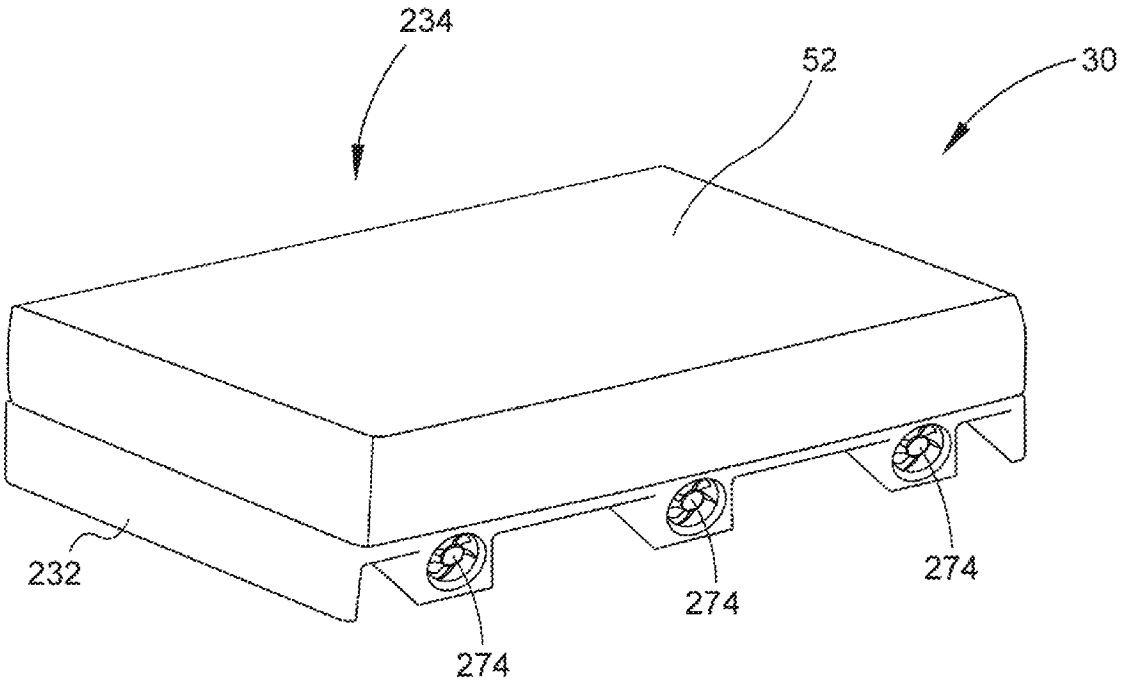
FIG. 15 is a perspective view of one embodiment of a bedding system, in accordance with the principles of the present disclosure.
Figure 16:
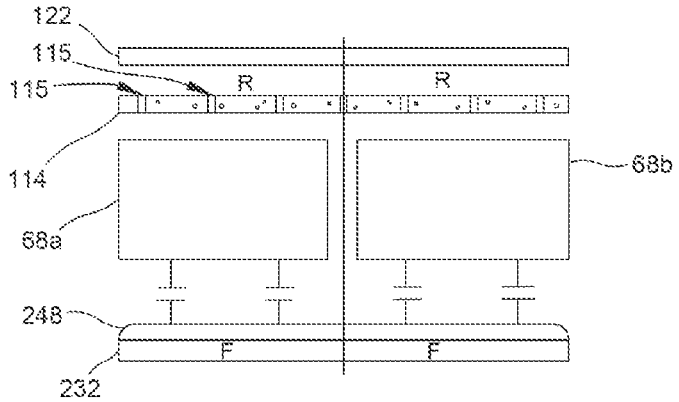
FIG. 16 is a side view of components of the bedding system shown in FIG. 15, with part separated.
Figure 17:
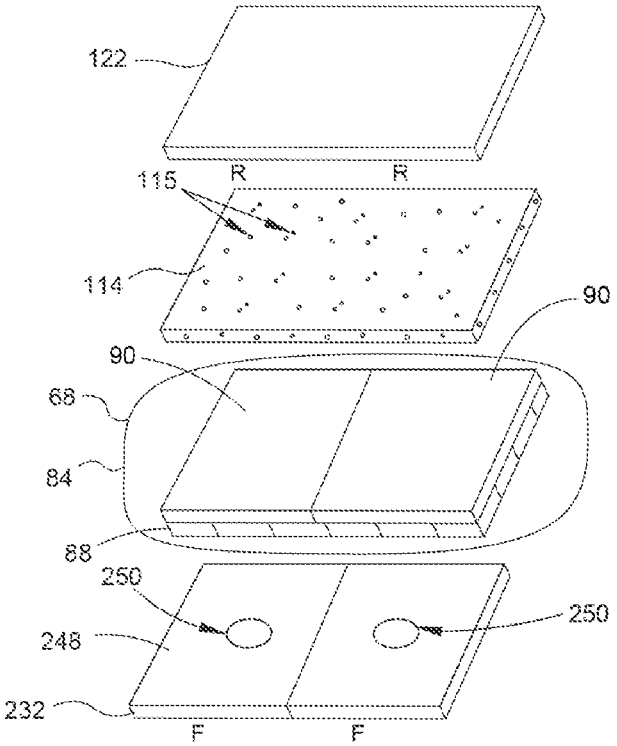
FIG. 17 is a perspective view of components of the bedding system shown in FIG. 15, with part separated.
Figure 18:
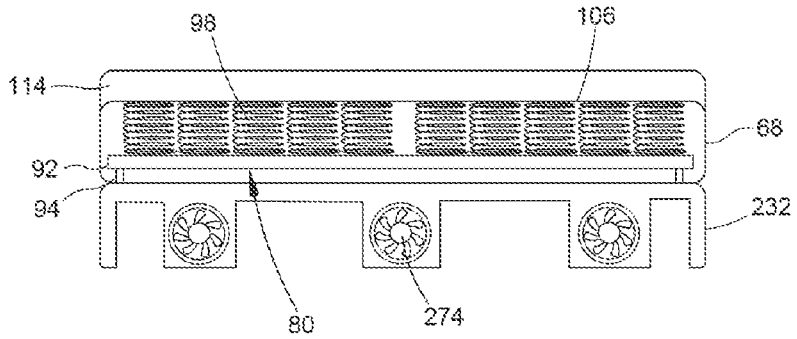
FIG. 18 is a side, cross-sectional view of components of the bedding system shown in FIG. 15.
Figure 19:
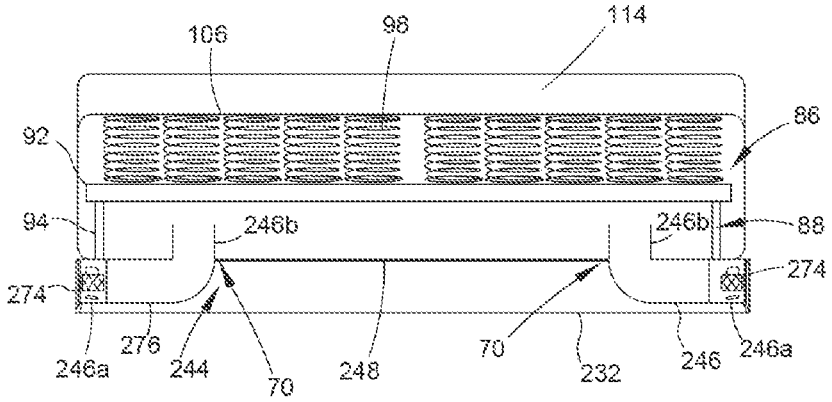
FIG. 19 is a side, cross-sectional view of components of the bedding system shown in FIG. 15.

In operation and use, one or more support assemblies 68 is/are inserted into cavity 66. A first end 72*a* of tube 72 is positioned through one of holes 70 and into one of ports 126. A second end 72*b* of tube 72 is connected with pressure generator 74, as shown in FIG. 14. Cover 106 is positioned over support assembly 68 such that teeth 100 of zipper 102 engage teeth 104 of zipper 102. Zipper 102 is then zipped up such that teeth 100 interdigitate with teeth 104 to attach cover 106 with chassis 54, as discussed herein. Comfort layer 114 is positioned on top of cover 106 such that teeth 108 of zipper 110 engage teeth 112 of zipper 110. Zipper 110 is then zipped up such that teeth 108 interdigitate with teeth 112 to attach comfort layer 114 with chassis 54, as discussed herein. Cover 122 is laid over comfort layer 114 such that teeth 116 of zipper 118 engage teeth 120 of zipper 118. Zipper 118 is then zipped up such that teeth 116 interdigitate with teeth 120 to attach comfort cover 122 with chassis 54, as discussed herein.

In some embodiments, pressure generator 74 is moved from an off position to an on position such that a fan 128 of pressure generator 74 creates positive pressure to blow air and/or moisture in recess 86 through apertures 96 and/or coil packs 90 such that the air and/or moisture will exit support assembly 68 through encasement 84. The air and/or moisture will then move through cover 106 and comfort layer 114 and exit mattress assembly 34 through cover 122 to provide a cooling effect to surface 56.

In some embodiments, pressure generator 74 is moved from an off position to an on position such that fan 128 creates negative pressure to draw air and/or moisture adjacent to surface 56 through cover 122, comfort layer 114, cover 106 and encasement 84 such that the air and/or moisture enters recess 86. The air and/or moisture will then move through apertures 96 and/or coil packs 90 and into pressure generator 74 to provide a cooling effect to surface 56.

In some embodiments, a kit is provided that includes one or more of the components of bedding system 30 discussed herein. For example, the kit may include one or more chassis, such as, for example, chassis 54 discussed herein. It is envisioned that the chassis of the kit may vary with respect to size, shape and/or material. The kit may include one or more first cover, such as, for example, cover 106 and one or more second cover, such as, for example, cover 122 discussed herein. It is envisioned that the covers of the kit may vary with respect to size, shape and/or material. For example, the covers may include different fill materials and/or may have different firmnesses. The kit may include one or more comfort layer, such as, for example, comfort layer 114 discussed herein. It is envisioned that the comfort layers of the kit may vary with respect to size, shape and/or material. The kit may include one or more support assemblies, such as, for example, support assembly 68 discussed herein. It is envisioned that the support assemblies of the kit may vary with respect to size, shape and/or material. For example, the support assemblies may include a plurality of coil packs having different firmnesses. In some embodiments, the kit includes other bedding items. For example, the kit may include a foundation, bed sheets, pillows, pillow cases, a blanket or comforter, etc.

In some embodiments, support assembly 68 does not include encasement 84 or any other structure that surrounds spacer 88 and coil pack 90 and chassis 54 is configured to resist and/or prevent the flow of air and/or moisture. For example, wall 56, wall 58, wall 60, wall 62 and/or wall 64 may be made of one or more materials that is impervious to air flow therethrough to create a barrier that does not allow air and/or moisture to move from one side of he barrier to an opposite side of the barrier. As such, any air and/or moisture that surrounds spacer 84 and coil pack 90 will be confined within cavity 66 when support assembly 58 is positioned in cavity 66.

In some embodiments, pressure generator 74 is moved from an off position to an on position such that fan 128 creates positive pressure to blow air and/or moisture in recess 86 through apertures 96 and/or coil packs 90 such that the air and/or moisture will exit support assembly 68 through cover 106. The air and/or moisture will then move through comfort layer 114 and exit mattress assembly 34 through cover 122 to provide a cooling effect to surface 56.

In some embodiments, pressure generator 74 is moved from an off position to an on position such that fan 128 creates negative pressure to draw air and/or moisture adjacent to surface 56 through cover 122, comfort layer 114 and cover 106 and encasement 84 such that the air and/or moisture enters moves through apertures 96 and/or coil packs 90 and into pressure generator 74 to provide a cooling effect to surface 56.

In one embodiment, shown in FIGS. 15-20, system 30 includes a mattress assembly 234 that is similar to mattress assembly 34. In contrast to mattress assembly 34, mattress assembly 234 does not include an external pressure generator. Rather, mattress assembly 234 one or a plurality of pressure generators, such as, for example, fans 274 that each incorporated into a fan box layer 232 of mattress assembly 234 to force air and/or moisture to surface 36 and/or pull air and/or moisture away from surface 36, as discussed herein. In some embodiments, mattress assembly 234 includes fan box layer 232 in place of chassis 54 and pressure generator 74, as discussed herein.

Figure 20:
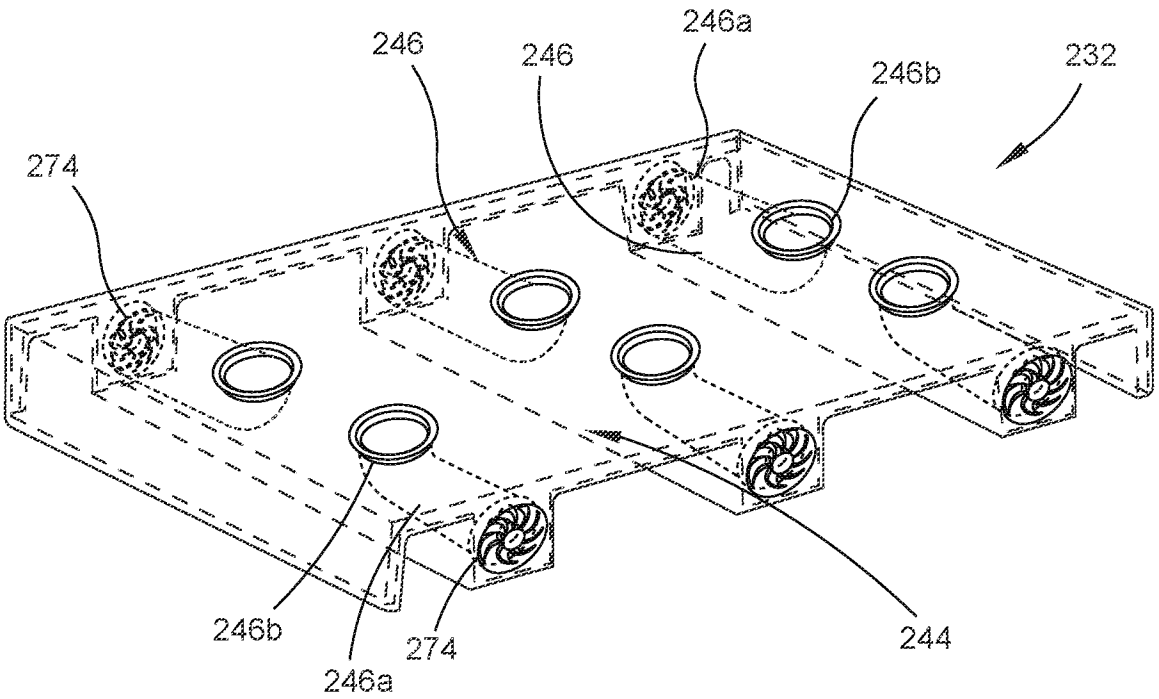
FIG. 20 is a perspective view, in part phantom, of a component of the bedding system shown in FIG. 15.

In some embodiments, fan box layer 232 includes a base, such as, for example, a housing 242 defining a cavity 244. Fans 274 are each coupled to housing 242, as best shown in FIG. 20. Fans 274 are each connected to a duct 246. In particular, a first end 246*a* of each of ducts 246 directly engages one of fans 274 and an opposite second end 246*b* of each of ducts 246 extends through one of ports 126 such that at least a portion of each of second ends 246*b* is positioned within recess 86. In some embodiments, fans 274 are inserted into ends 246*a* such that ends 246*a* surround at least a portion of fans 274 to direct air flow generated by fans 274 through ducts 246.

One or a plurality of support assemblies 68 are positioned on top of fan box layer 232 such that ends 246*b* extend into recess 86. In some embodiments, ends 246*b* are positioned between legs 94. In some embodiments, ends 246*b* are positioned between platform 92 and fans 274. In some embodiments, support assembly 68 is removably positioned on top of fan box layer 232 without being attached to fan box layer 232 by any connectors, fasteners, etc. In some embodiments, support assembly 68 is coupled to fan box layer 232 using connectors or fasteners, such as, for example, zippers. For example, in one embodiment, a first row of teeth of a zipper are positioned about a perimeter of housing 242 and a second row of teeth of the zipper are positioned about a perimeter of support assembly 68. The rows of teeth are configured to engage and interdigitate with one another to couple support assembly 68 to fan box layer 232.

In some embodiments, a tambour 248 is positioned between fan box layer 232 and support assembly 68. Tambour 248 includes a plurality of fan ports 250 that each extend through a thickness of tambour 248. In some embodiments, the number of fan ports 250 in tambour 248 is equal to the number of ducts 246. Ends 246*b* of ducts 246 are configured to extend through fan ports 250 for positioning of ends 246*b* within recess 86. In some embodiments, tambour 248 is removably coupled to housing 242. In some embodiments, tambour 248 is permanently coupled to housing 242 such that tambour 248 cannot be removed from housing 242 without breaking tambour 248 and/or housing. In some embodiments, tambour 248 comprises a non-breathable and/or non-porous material that prevents the flow of air and/or moisture therethrough. That is, tambour 248 defines an air flow barrier that prevents air and/or moisture from moving from one side of the barrier to the other side of the barrier. In some embodiments, ducts 246 form a seal with fan ports 250 such that no air or moisture can move between ducts 246 and fan ports 250.

In operation and use, one or more support assemblies 68 is/are positioned over fan box layer 232 and tambour 248 such that ends 246*b* of ducts 246 extend through fan ports 250 and into recess 86. Comfort layer 114 is positioned on top of support assembly 68. In some embodiments, comfort layer 114 is removably positioned on top of support assembly 68 without being attached to support assembly 68 and/or housing 242 by any connectors, fasteners, etc. In some embodiments, comfort layer 114 is coupled to fan box layer 232 using connectors or fasteners, such as, for example, zippers. For example, in one embodiment, a first row of teeth of a zipper are positioned about a perimeter of housing 242 and a second row of teeth of the zipper are positioned about a perimeter of comfort layer 114. The rows of teeth are configured to engage and interdigitate with one another to couple comfort layer 114 to fan box layer 232. Cover 122 is laid over comfort layer 114. In some embodiments, cover 122 is removably positioned on top of comfort layer 114 without being attached to comfort layer 114 and/or housing 242 by any connectors, fasteners, etc. In some embodiments, cover 122 is coupled to fan box layer 232 using connectors or fasteners, such as, for example, zippers. For example, in one embodiment, a first row of teeth of a zipper are positioned about a perimeter of housing 242 and a second row of teeth of the zipper are positioned about a perimeter of cover 122. The rows of teeth are configured to engage and interdigitate with one another to couple cover 122 to fan box layer 232.

In some embodiments, fans 274 are each moved from an off position to an on position such that fans 274 create positive pressure to blow air and/or moisture in recess 86 through apertures 96 and/or coil packs 90. The air and/or moisture will then move through comfort layer 114 and exit mattress assembly 234 through cover 122 to provide a cooling effect to surface 56.

In some embodiments, fans 274 are each moved from an off position to an on position such that fans 274 create negative pressure to draw air and/or moisture adjacent to surface 56 through cover 122 and comfort layer 114 such that the air and/or moisture enters recess 86. The air and/or moisture will then move through apertures 96 and/or coil packs 90 and into ducts 246. The air and/or moisture will then exit ducts 246 to an area surrounding fan box layer 232 to provide a cooling effect to surface 56.

In some embodiments, a kit is provided that includes one or more of the components of bedding system 30 discussed herein. For example, the kit may include one or more chassis, such as, for example, fan box layer 232 discussed herein. It is envisioned that the fan box layer of the kit may vary with respect to size, shape and/or material. For example, the fan box layers may differ with respect to the number of fans. The kit may include one or more tambour, such as, for example, tambour 248. It is envisioned that the tambours of the kit may vary with respect to size, shape and/or material. The kit may include one or more comfort layer, such as, for example, comfort layer 114 discussed herein. It is envisioned that the comfort layers of the kit may vary with respect to size, shape and/or material. The kit may include one or more support assemblies, such as, for example, support assembly 68 discussed herein. It is envisioned that the support assemblies of the kit may vary with respect to size, shape and/or material. For example, the support assemblies may include a plurality of coil packs having different firmnesses. In some embodiments, the kit includes other bedding items. For example, the kit may include a foundation, bed sheets, pillows, pillow cases, a blanket or comforter, etc.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A bedding system comprising:

a base;

a pressure generator coupled to the base;

a chassis positioned over the base and defining a cavity;

a support assembly positioned within the cavity, the support assembly comprising an encasement, a spacer and a coil pack positioned over the spacer, the spacer and the coil pack each being positioned within a recess of the encasement;

an air passage being spaced apart from the spacer and including a first end that is in communication with the pressure generator and a second end that is in communication with the recess;

a comfort layer positioned over the encasement and attached to the chassis by a first zipper; and a cover positioned over the comfort layer and attached to the chassis by a second zipper.

2. The bedding system recited in claim 1, wherein the spacer includes a platform and spaced apart legs coupled to the platform, the second end being positioned between the legs.

3. The bedding system recited in claim 1, wherein the spacer includes a platform and a plurality of legs that support the platform, the pressure generator being positioned below the legs, the second end being positioned between two of the legs.

4. The bedding system recited in claim 1, wherein the coil pack comprises a plurality of pockets and at least one spring positioned in each pocket.

5. The bedding system recited in claim 1, wherein the comfort layer is perforated for airflow therethrough.

6. The bedding system recited in claim 1, wherein:

the comfort layer includes a plurality of spaced apart channels that each extend completely through a thickness of the comfort layer; and the cover is configured to allow at least one of air and moisture to move through a thickness of the cover.

7. The bedding system recited in claim 1, further comprising a second cover positioned between the encasement and the comfort layer.

8. The bedding system recited in claim 7, wherein the comfort layer includes opposite top and bottom surfaces and a wall connecting the top and bottom surfaces of the comfort layer, the second cover covering the top surface of the comfort layer and a portion of the wall.

9. The bedding system recited in claim 1, wherein a top surface of the encasement defines a first perimeter, the cover defining a second perimeter, the second perimeter defining an area that is greater than an area defined by the first perimeter such that the second perimeter overhangs the first perimeter.

10. The bedding system recited in claim 1, wherein the base includes opposite top and bottom surfaces, opposite first and second end walls, opposite first and second side walls, the top wall defining the top surface of the base and the bottom wall defining the bottom surface of the base, the end walls and the side walls each extending from the top surface to the bottom surface, the cover having a porosity.

11. The bedding system recited in claim 1, wherein the base includes opposite top and bottom surfaces, opposite first and second end walls, opposite first and second side walls, the top wall defining the top surface of the base and the bottom wall defining the bottom surface of the base, the end walls and the side walls each extending from the top surface to the bottom surface.

12. The bedding system recited in claim 1, further comprising a tambour that directly engages the top wall of the base and the bottom surface of the encasement, the second end extending through the tambour.

13. A bedding system comprising:

a base;

a pressure generator coupled to the base;

a chassis positioned over the base and defining a cavity;

a support assembly positioned within the cavity, the support assembly comprising an encasement and a coil pack positioned within a recess of the encasement;

an air passage being spaced apart from the coil pack and including a first end that is in communication with the pressure generator and a second end that is in communication with the recess;

a comfort layer positioned over the encasement and attached to the chassis by a first zipper; and a cover positioned over the comfort layer and attached to the chassis by a second zipper.

14. The bedding system recited in claim 13, wherein the coil pack comprises a plurality of pockets and at least one spring positioned in each pocket.

15. The bedding system recited in claim 13, wherein the comfort layer is perforated for airflow therethrough.

16. The bedding system recited in claim 13, wherein:

the comfort layer includes a plurality of spaced apart channels that each extend completely through a thickness of the comfort layer; and the cover is configured to allow at least one of air and moisture to move through a thickness of the cover.

17. The bedding system recited in claim 13, further comprising a second cover positioned between the encasement and the comfort layer.

18. The bedding system recited in claim 17, wherein the comfort layer includes opposite top and bottom surfaces and a wall connecting the top and bottom surfaces of the comfort layer, the second cover engaging the bottom surface of the comfort layer.

19. The bedding system recited in claim 13, wherein the base includes opposite top and bottom surfaces, opposite first and second end walls, opposite first and second side walls, the walls each extending from the top surface to the bottom surface, the cover having a porosity.

20. The bedding system recited in claim 13, wherein the base includes opposite top and bottom surfaces, opposite first and second end walls, opposite first and second side walls, the walls each extending from the top surface to the bottom surface.

21. The bedding system recited in claim 13, wherein the encasement sits on the base such that a bottom surface of the encasement directly engages the top surface of the base.

22. The bedding system recited in claim 2, wherein the platform is configured to allow at least one of air and moisture to move through a thickness of the platform.

23. The bedding system recited in claim 2, wherein the coil pack is configured to allow at least one of air and moisture to move through a thickness of the coil pack.

24. The bedding system recited in claim 13, wherein the coil pack is configured to provide at least one air channel to allow air to move therethrough.

25. The bedding system recited in claim 13, further comprising one of an air chamber and at least one air channel within the recess of the encasement to allow air to move through the encasement.

* * * * *